US007278377B1

(12) United States Patent
Stephens

(10) Patent No.: US 7,278,377 B1
(45) Date of Patent: Oct. 9, 2007

(54) POOP SCOOP AND BAGGER

(76) Inventor: Chris Stephens, 4348 Roma Blvd., Jacksonville, FL (US) 32210

( * ) Notice: Subject to any disclaimer, the term of this patent is extended or adjusted under 35 U.S.C. 154(b) by 109 days.

(21) Appl. No.: 10/921,122

(22) Filed: Aug. 19, 2004

(51) Int. Cl.
*A01K 23/00* (2006.01)

(52) U.S. Cl. ..... 119/867

(58) Field of Classification Search ..... None
See application file for complete search history.

(56) References Cited

U.S. PATENT DOCUMENTS 3,986,744 A * 10/1976 Krogstad et al. ..... 294/1.3
4,896,912 A 1/1990 Parnell
5,382,063 A 1/1995 Wesener et al.
5,564,762 A 10/1996 Ring
6,158,395 A * 12/2000 Bauklon ..... 119/867
6,439,627 B1 8/2002 Devane
6,485,073 B2 * 11/2002 Harrison ..... 294/1.4
6,641,188 B2 * 11/2003 Arceo ..... 294/1.4
6,941,896 B1 * 9/2005 Morin ..... 119/867

* cited by examiner

*Primary Examiner*—Robert P. Swiatek
*Assistant Examiner*—Bethany L. Griles
(74) *Attorney, Agent, or Firm*—Patent & Trademark Services, Inc.; Joseph H. McGlynn

(57) ABSTRACT

A pickup device that has a scoop for picking up waste and the device has a plastic bag lining the device which can be used to dispose of the waste.

6 Claims, 1 Drawing Sheet

POOP SCOOP AND BAGGER

BACKGROUND OF THE INVENTION

This invention relates, in general, to a waste pickup device, and, in particular, to a waste pickup device that has a bag into which the waste can be placed.

DESCRIPTION OF THE PRIOR ART

In the prior art various types of pickup devices have been proposed. For example, U.S. Pat. No. 5,382,063 to Wesener et al discloses a waste collector having a container with a handle and a pivoted lid to contain the waste.

U.S. Pat. No. 4,896,912 to Parnell discloses a waste collector in which a plastic bag is tied around the entire collector.

U.S. Pat. No. 6,439,627 to Devane discloses a waste collector in which a plastic bag is placed within a container and is secured with tape and a relief notch in the back of the container.

U.S. Pat. No. 5,564,762 to Ring discloses a waste collector having a container with an open end a bag which completely surrounds the container and a pusher member for pushing waste into the collector.

SUMMARY OF THE INVENTION

The present invention is directed to a pickup device that has a scoop for picking up waste and the device has a plastic bag lining the device which can be used to dispose of the waste.

It is an object of the present invention to provide a new and improved pickup device for collecting and disposing of waste.

It is an object of the present invention to provide a new and improved pickup device which incorporates a plastic bag to handle the waste.

It is an object of the present invention to provide a new and improved pickup device which is easy to use and inexpensive to manufacture.

These and other objects and advantages of the present invention will be fully apparent from the following description, when taken in connection with the annexed drawings.

DESCRIPTION OF THE PREFERRED EMBODIMENT

Figure 1:
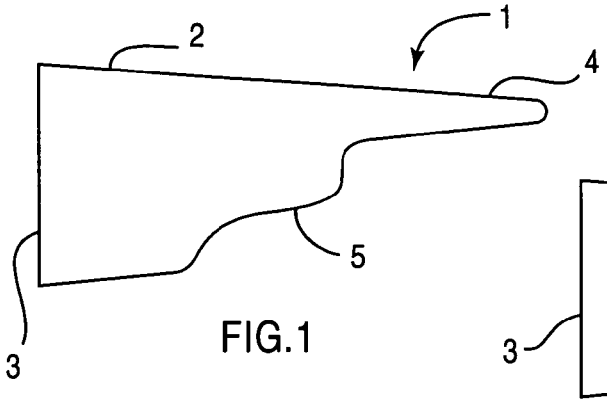
FIG. 1 is a side view of the present invention.
Figure 2:
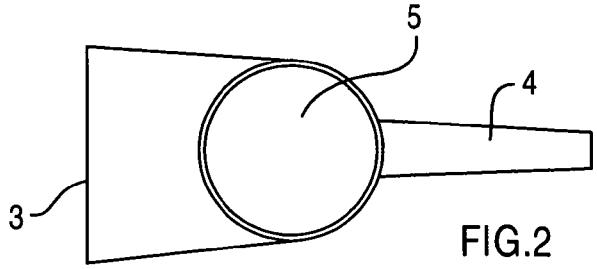
FIG. 2 is a bottom view of the present invention.

Referring now to the drawings in greater detail, FIG. 1 shows a side view of the present invention 1. The scoop 1 is essentially funnel shaped and has a top surface 2, an open front 3, a handle 4 at the back of the scoop, and an aperture 5 in the bottom of the scoop. The aperture 5 can be more clearly seen in FIG. 2. The aperture 5 communicates with the open front end 3 of the scoop 1, and allows an ordinary plastic grocery bag 6 (shown in FIGS. 3-5) to be inserted into the front end of the scoop and out through the aperture 5 in the bottom of the scoop.

Figure 3:
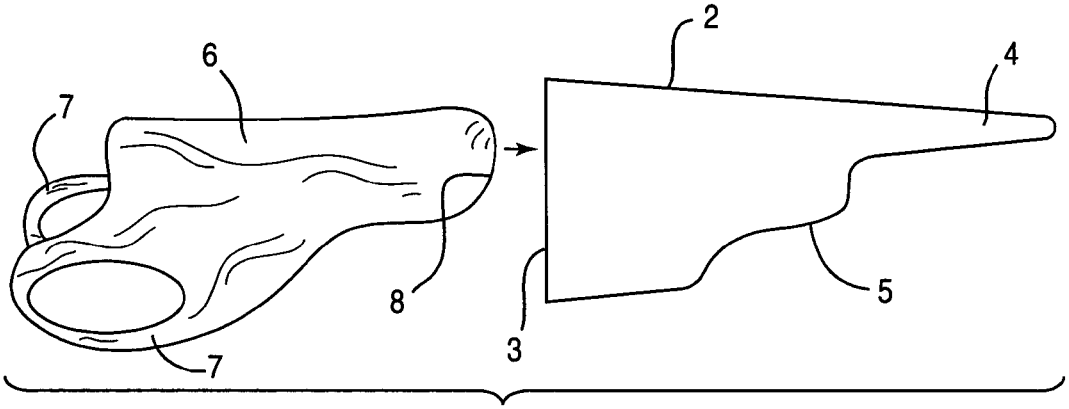
FIG. 3 is a side view of the present invention and a plastic bag about to be inserted into the present invention.

FIG. 3 shows an ordinary plastic grocery bag 6 about to be inserted through the open front end 3 of the scoop. The plastic bag has a rear end 8 which is inserted first through the front end of the scoop. The handles 7 of the bag are located at the front ends of the bag and are furthest away from the open end 3 of the scoop.

Figure 4:
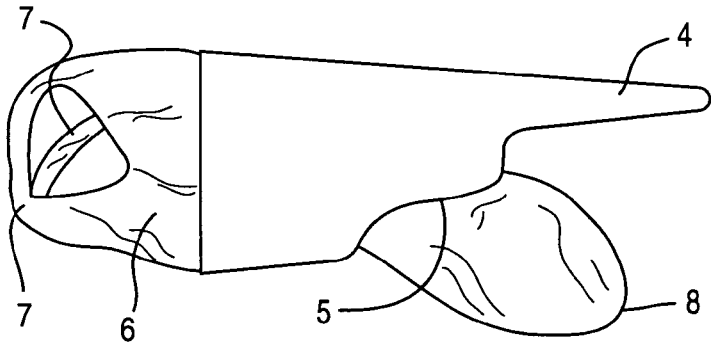
FIG. 4 is a side view of the present invention and a plastic bag inserted into the present invention.

As seen in FIG. 4, once the bottom 8 of the bag 6 is inserted into the scoop, it is drawn through the aperture 5 until the bottom 8 protrudes from the bottom of the scoop. With the bottom 8 protruding from the aperture 5, the handles 7 and a good portion of the front of the bag 6 still protrudes from the front of the scoop.

Once the bag 6 and the scoop 1 are in the relative position shown in FIG. 4, the handles 7 and the remaining front end of the bag 6 can be passed over the outside surface of the scoop 1. A user can then grasp the handles 7 with the thumb and fore finger of one hand 9 and hold them against the handle 4. This allows the leading edge of the opening 3 of the scoop to be covered by the bag 6. When a user scoops waste with the leading edge of the scoop, the bag 6 will prevent the scoop from being soiled. The interior surfaces of the scoop will not be soiled since they are also covered by the bag. In fact, the interior surfaces of the bag 6 are the only surfaces that will contact the waste and be soiled by the waste. This eliminates the need to clean the scoop and discourages unsanitary conditions.

Figure 5:
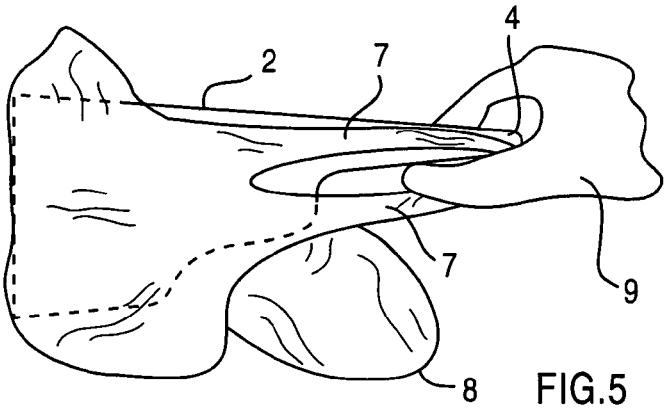
FIG. 5 is a side view of the present invention and a plastic bag inserted into the present invention and a partial view of a user's hand holding the invention and the bag.

In order to use the present invention 1, a conventional plastic bag 1 is inserted into the open end 3 of the scoop with the bottom 8 of the bag being closest to the scoop and the handles 7 and the open end of the bag being remote from the open end 3. The bottom 8 of the bag is passed through the scoop and brought out through the aperture 5 in the bottom of the scoop, as shown in FIGS. 4 and 5. The user would then fold the bag over the outside of the scoop until the handles 7 are adjacent the handle 4 of the scoop. The user would then pinch the handles 7 against the handle 4 of the scoop using his/her thumb and fore finger.

The user would then be ready to scoop up waste by using the front edge of the scoop. As the waste is brought into the scoop, the user could tilt the scoop so the waste would fall into the portion of the bag 6 that protrudes from the aperture 5 and the bottom of the scoop 1. With the waste in the protruding portion of the bag, it cannot fall out accidentally, and the user can scoop additional waste without the danger of the waste, already scooped, falling out.

Once scooping is complete, the user releases the handles 7 of the bag 6, and the filled bag falls out through the bottom opening 5 and into a container for disposal. During the entire scooping process the waste will only make contact with the interior portion of the bag 6.

It should be noted that the present invention has been described as using a conventional plastic grocery bag, however, it should be understood that any container that can serve the intended purpose can be used without departing from the scope of the invention.

Although the Poop Scoop & Bagger and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A method of using a scooping device for scooping and disposing of waste, said scooping device comprising:

a body having a front, a back, a top and a bottom, said front having means for receiving a plastic bag, said bottom having means for receiving said plastic bag and allowing said plastic bag to protrude from said bottom, a handle attached to said back, and wherein said method comprises:

inserting a bottom of a plastic bag into said front of said body, continuing to insert said plastic bag until said bottom of said plastic bag protrudes from said means for receiving said plastic bag in said bottom and a front of said plastic bag protrudes from said front of said body, folding said front of said plastic bag over an outside surface of said body until handles on said front of said plastic bag are adjacent said handle, pinching said handles on said plastic bag to said handle on said body, using said front of said body to scoop waste, manipulating said waste until said waste falls into said bottom of said plastic bag protruding from said means for receiving said plastic bag in said bottom of said body.

2. The method of using a scooping device for scooping and disposing of waste as claimed in claim 1, wherein said method additionally includes:

using said front of said body to scoop additional waste, manipulating said additional waste until said additional waste falls into said bottom of said plastic bag protruding from said means for receiving said plastic bag in said bottom of said body.

3. A scooping device for scooping and disposing of waste in combination with a container, said scooping device comprising:

a body having a front, a back, a top and a bottom, said front having means for receiving said container, said bottom having means for receiving said container, and said container protruding from said bottom and said front when said container is fully inserted into said scooping device, a handle attached to said back, and wherein a portion of said container extends from said front of said body and along a portion of an exterior portion of said body, and wherein said portion of said container extends along said handle.

4. The scooping device as claimed in claim 3, wherein said means in said front for receiving said container is an opening which communicates with an interior of said body.

5. The scooping device as claimed in claim 3, wherein said means in said bottom for receiving said container is an opening which communicates with an interior of said body.

6. The scooping device as claimed in claim 3, wherein said means in said front for receiving said container is an opening which communicates with an interior of said body, and said means in said bottom for receiving said container is an opening which communicates with an interior of said body, and said opening in said front communicates with said opening in said bottom.

* * * * *